US011925974B2

(12) United States Patent
Masuda et al.

(10) Patent No.: US 11,925,974 B2
(45) Date of Patent: Mar. 12, 2024

(54) BREAKOUT PREDICTION METHOD, OPERATION METHOD OF CONTINUOUS CASTING MACHINE, AND BREAKOUT PREDICTION DEVICE

(71) Applicant: JFE STEEL CORPORATION, Tokyo (JP)

(72) Inventors: Ryosuke Masuda, Tokyo (JP); Yoshinari Hashimoto, Tokyo (JP); Akitoshi Matsui, Tokyo (JP); Shugo Morita, Tokyo (JP); Tatsuro Hayashida, Tokyo (JP); Taiga Koriyama, Tokyo (JP); Takehide Hirata, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 18/009,909

(22) PCT Filed: Apr. 9, 2021

(86) PCT No.: PCT/JP2021/015092
§ 371 (c)(1),
(2) Date: Dec. 12, 2022

(87) PCT Pub. No.: WO2021/256063
PCT Pub. Date: Dec. 23, 2021

(65) Prior Publication Data

US 2023/0226600 A1 Jul. 20, 2023

(30) Foreign Application Priority Data

Jun. 18, 2020 (JP) ..... 2020-105070

(51) Int. Cl.
*B22D 11/18* (2006.01)
*B22D 2/00* (2006.01)
*B22D 11/04* (2006.01)

(52) U.S. Cl.
CPC ..... *B22D 11/182* (2013.01); *B22D 2/00* (2013.01); *B22D 11/04* (2013.01)

(58) Field of Classification Search
CPC ..... B22D 11/182; B22D 11/04; B22D 2/00
See application file for complete search history.

(56) References Cited

U.S. PATENT DOCUMENTS

| | | | |
|---|---|---|---|
| 5,548,520 | A | 8/1996 | Nakamura et al. |
| 11,105,758 | B2 | 8/2021 | Wang et al. |
| 2021/0048402 | A1 | 2/2021 | Wang et al. |

FOREIGN PATENT DOCUMENTS

| | | | |
|---|---|---|---|
| CN | 105328155 | A | 2/2016 |
| CN | 109396375 | B | 9/2019 |

(Continued)

OTHER PUBLICATIONS

English Machine Translation of JP 2012-139713 A (Year: 2012).*

(Continued)

*Primary Examiner* — Kevin P Kerns
*Assistant Examiner* — Steven S Ha
(74) *Attorney, Agent, or Firm* — Oliff PLC

(57) ABSTRACT

A breakout prediction method includes: a step of inputting a dimension of a solid product withdrawn from a mold in a continuous casting machine; a step of detecting a temperature of the mold by a plurality of thermometers embedded in the mold; a step of executing interpolation processing on the detected temperatures detected by the plurality of thermometers according to the dimension of the solid product; a step of calculating, based on the temperatures calculated by executing the interpolation processing, a component in a (Continued)

direction orthogonal to an influence coefficient vector obtained by principal component analysis as a degree of deviation from during a normal operation in which a breakout has not occurred; and a step of predicting a breakout based on the degree of deviation.

10 Claims, 12 Drawing Sheets

(56) References Cited

FOREIGN PATENT DOCUMENTS

| | | | |
|---|---|---|---|
| EP | 1 428 598 | A1 | 6/2004 |
| JP | 2001-287001 | A | 10/2001 |
| JP | 2001-287004 | A | 10/2001 |
| JP | 2012-139713 | A | 7/2012 |
| JP | 5673100 | B2 | 2/2015 |
| JP | 2017-154155 | A | 9/2017 |
| JP | 2020-011255 | A | 1/2020 |
| SU | 1279744 | A1 | 12/1986 |
| SU | 1366282 | A1 | 1/1988 |
| TW | 252935 | B | 8/1995 |

OTHER PUBLICATIONS

Jul. 28, 2023 Office Action issued in Russian Patent Application No. 2022132800.

Mar. 22, 2023 Extended European Search Report issued in Patent Application No. 21826706.0.

Sep. 26, 2022 Office Action issued in Taiwanese Patent Application No. 110117845.

Jun. 8, 2021 International Search Report issued in International Patent Application No. PCT/JP2021/015092.

* cited by examiner

FIG.8
(a)
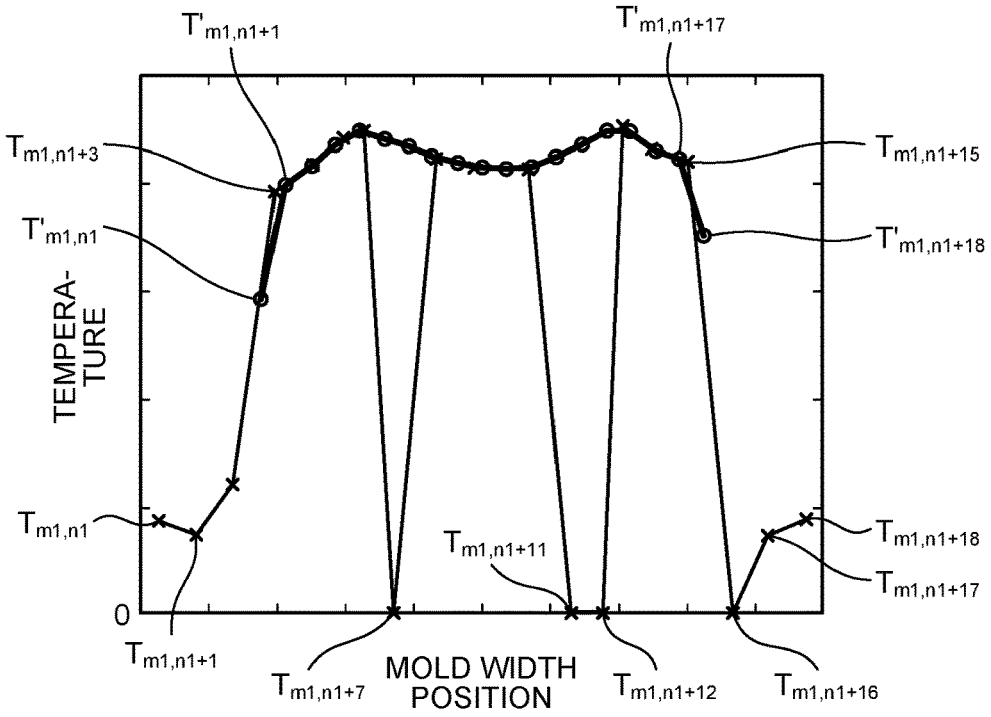
(b)
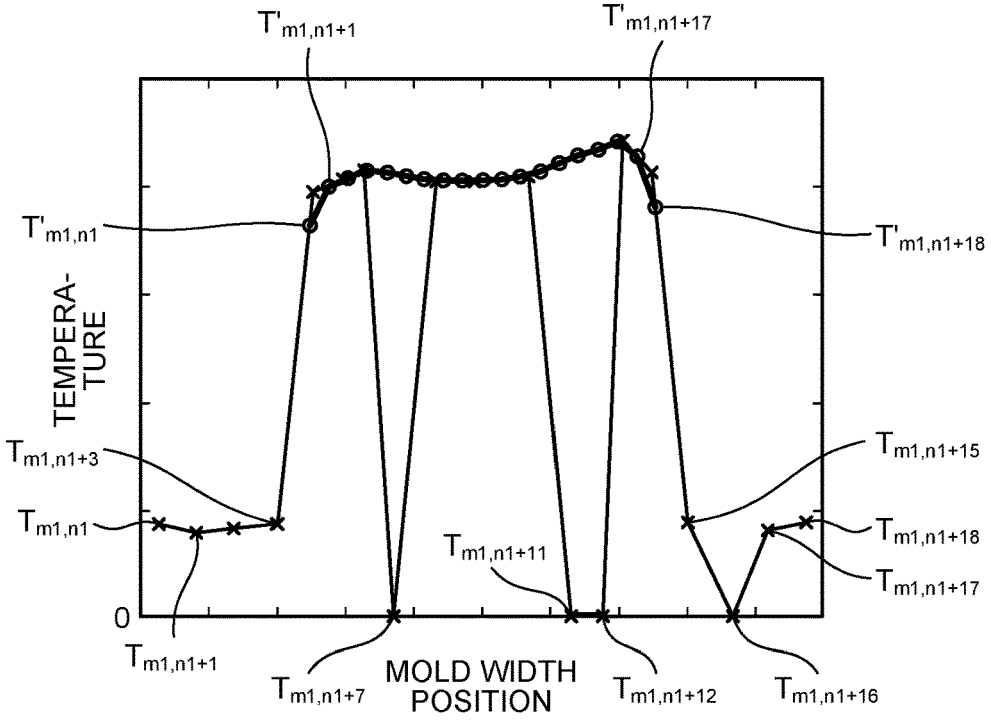

FIG.13

| UPPER-STAGE CALCULATION CELL | $12_{1,1}$ | $12_{1,2}$ | $12_{1,3}$ | $12_{1,4}$ | $12_{1,5}$ | $12_{1,6}$ | … | $12_{1,p-2}$ | $12_{1,p-1}$ | $12_{1,p}$ |
|---|---|---|---|---|---|---|---|---|---|---|
| SCORE BY CALCULATION CELL | 0 | 0 | 1 | 1 | 1 | 0 | … | 0 | 0 | 0 |
| × | × | × | × | × | × | × | | × | × | × |
| FORWARD SHIFT VECTOR | 0 | 1 | 1 | 1 | 0 | 0 | … | 0 | 0 | 0 |
| × | × | × | × | × | × | × | | × | × | × |
| BACKWARD SHIFT VECTOR | 0 | 0 | 0 | 1 | 1 | 1 | … | 0 | 0 | 0 |
| = | = | = | = | = | = | = | | = | = | = |
| UPPER-STAGE ADJACENT PRODUCT VECTOR | 0 | 0 | 0 | 1 | 0 | 0 | … | 0 | 0 | 0 |

| LOWER-STAGE CALCULATION CELL | $12_{2,1}$ | $12_{2,2}$ | $12_{2,3}$ | $12_{2,4}$ | $12_{2,5}$ | $12_{2,6}$ | … | $12_{2,p-2}$ | $12_{2,p-1}$ | $12_{2,p}$ |
|---|---|---|---|---|---|---|---|---|---|---|
| SCORE BY CALCULATION CELL | 0 | 0 | 1 | 0 | 0 | 0 | … | 0 | 0 | 0 |
| + | + | + | + | + | + | + | | + | + | + |
| FORWARD SHIFT VECTOR | 0 | 1 | 0 | 0 | 0 | 0 | … | 0 | 0 | 0 |
| + | + | + | + | + | + | + | | + | + | + |
| BACKWARD SHIFT VECTOR | 0 | 0 | 0 | 1 | 0 | 0 | … | 0 | 0 | 0 |
| = | = | = | = | = | = | = | | = | = | = |
| LOWER-STAGE ADJACENT SUM VECTOR | 0 | 1 | 1 | 1 | 0 | 0 | … | 0 | 0 | 0 |

| | | | | | | | | | | |
|---|---|---|---|---|---|---|---|---|---|---|
| UPPER-STAGE ADJACENT PRODUCT VECTOR | 0 | 0 | 0 | 1 | 0 | 0 | … | 0 | 0 | 0 |
| × | × | × | × | × | × | × | | × | × | × |
| LOWER-STAGE ADJACENT SUM VECTOR | 0 | 1 | 1 | 1 | 0 | 0 | … | 0 | 0 | 0 |
| = | = | = | = | = | = | = | | = | = | = |
| UPPER/LOWER ADJACENT PRODUCT VECTOR | 0 | 0 | 0 | 1 | 0 | 0 | … | 0 | 0 | 0 |

BREAKOUT PREDICTION METHOD, OPERATION METHOD OF CONTINUOUS CASTING MACHINE, AND BREAKOUT PREDICTION DEVICE

FIELD

The present invention relates to a breakout prediction method, an operation method of a continuous casting machine, and a breakout prediction device.

BACKGROUND

Conventionally, as an operation method of a continuous casting machine, there is known a continuous casting process in which molten steel is poured into a mold, the poured molten steel is cooled by the mold in which a water-cooling pipe is embedded to solidify the surface of the molten steel, a semi-solidified solid product is withdrawn from the lower portion of the mold by a drawing roll, and finally a completely solidified solid product is produced by spray cooling. In the continuous casting process, improvement in productivity by high-speed casting is increasingly required. On the other hand, an increase in the casting speed causes a decrease in the thickness of the solidified shell of the solid product at the lower end of the mold and an uneven distribution of the thickness of the solidified shell. As a result, a so-called breakout may occur in which the solidified shell is broken to cause leakage of steel when a portion having a small thickness of the solidified shell exits the mold. When a breakout occurs, a long down time occurs, and thus productivity is significantly deteriorated. Therefore, there is a demand for a breakout prediction method capable of accurately predicting occurrence of breakout while performing high-speed casting.

As a breakout prediction method, for a countermeasure against a sticking breakout in which a solidified shell is stuck by a mold, it is known that a breakout is predicted by detecting that the solidified shell is stuck by the mold from a change in temperature measured by a temperature measuring device such as a thermocouple embedded in a copper plate.

For example, Patent Literature 1 discloses a method of monitoring a sticking breakout in which a plurality of temperature measuring devices is horizontally arranged below a molten metal surface of a mold of a continuous casting machine to form a temperature measuring array, the temperature measuring arrays are arranged in a plurality of stages in a casting direction, the temperature measuring devices arranged in the upper-stage temperature measuring array and the temperature measuring devices arranged in the lower-stage temperature measuring array, among any two stages of the plurality of stages, are arranged on the same vertical line, the measured values of the temperature measuring devices are transmitted to an arithmetic device, and it is determined that the sticking breakout occurs when both of the following conditions 1 and 2 are satisfied.

Condition 1: In the upper-stage temperature measuring array and/or the lower-stage temperature measuring array, the measured values of the temperature measuring devices adjacent to each other increase and further decrease.

Condition 2: The measured value of the lower-stage temperature measuring device arranged on the vertical line is higher than the measured value of the upper-stage temperature measuring device.

Patent Literature 2 discloses a breakout prediction method including: a step of detecting a temperature of a mold by a plurality of thermometers embedded in the mold of a continuous casting machine and having sensitivity coefficients obtained; a step of defining a vector having a sensitivity coefficient of each of the plurality of thermometers as a component as a sensitivity coefficient vector and a vector having a detection value of each of the plurality of thermometers as a component as a detection temperature vector; a step of calculating the component of the detected temperature vector in a direction orthogonal to the sensitivity coefficient vector as a degree of deviation; a step of giving a first score to a thermometer in which the component of the degree of deviation exceeds a threshold; a step of defining a score vector by thermometer in which the first score is defined as a score by thermometer, and presence or absence of a score of each of the plurality of thermometers is defined as a component; a step of giving a second score to a central thermometer when scores are given to each thermometer and a thermometer adjacent to each thermometer, in the score vector by thermometer; and a step of detecting occurrence of a sign of breakout by the second score.

CITATION LIST

Patent Literature

Patent Literature 1: JP 2017-154155 A
Patent Literature 2: JP 5673100 B2

SUMMARY

Technical Problem

However, the method of monitoring the sticking breakout disclosed in Patent Literature 1 is configured to obtain the temperature change amount with respect to the time-series data of the detected temperature. Therefore, even if the detected temperature has changed due to a factor other than a sign of breakout, such as a change in the casting speed, there is a possibility of erroneous detection that a breakout may occur.

The breakout prediction method disclosed in Patent Literature 2 defines the temperature measurement value itself as a detected temperature vector to calculate the degree of deviation. Therefore, at the time of non-steady operation such as changing the width of a solid product during operation, the degree of deviation increases due to a change in, for example, the casting width of molten steel with respect to the mold, and there is a possibility of erroneous detection that a breakout may occur.

The present invention has been made in view of the above problems, and an object of the present invention is to provide a breakout prediction method, an operation method of a continuous casting machine, and a breakout prediction device capable of accurately predicting a breakout.

Solution to Problem

To solve the above-described problem and achieve the object, a breakout prediction method according to the present invention includes: a step of inputting a dimension of a solid product withdrawn from a mold in a continuous casting machine; a step of detecting a temperature of the mold by a plurality of thermometers embedded in the mold; a step of executing interpolation processing on the detected temperatures detected by the plurality of thermometers according to the dimension of the solid product; a step of calculating, based on the temperatures calculated by executing the interpolation processing, a component in a direction orthogonal to an influence coefficient vector obtained by principal component analysis as a degree of deviation from during a normal operation in which a breakout has not occurred; and a step of predicting a breakout based on the degree of deviation.

Moreover, in the above-described breakout prediction method according to the present invention, the step of executing the interpolation processing includes calculating a temperature by executing the interpolation processing on the detected temperature of each of the plurality of thermometers, at a center point of each of a plurality of calculation cells equally divided according to the dimension of the solid product.

Moreover, in the above-described breakout prediction method according to the present invention, number of the calculation cells is kept constant even when the dimension of the solid product is changed.

Moreover, in the above-described breakout prediction method according to the present invention, the step of calculating as the degree of deviation includes obtaining an average value of a temperature of each of the plurality of calculation cells located at a same distance from an upper end of the mold in a casting direction of a molten steel with respect to the mold, obtaining a difference from the average value for the temperature of each of the plurality of calculation cells, and calculating the degree of deviation from the obtained difference using the influence coefficient vector.

Moreover, in the above-described breakout prediction method according to the present invention, the step of predicting the breakout includes predicting a breakout based on an adjacency of the calculation cell in which an absolute value of the degree of deviation exceeds a preset second threshold when a time change rate of the degree of deviation exceeds a preset first threshold.

Moreover, in the above-described breakout prediction method according to the present invention, the step of predicting the breakout includes a step of giving a first score to the calculation cell in which the degree of deviation exceeds the second threshold, a step of calculating a second score from the first score based on the adjacency of the calculation cell to which the first score is given, and a step of predicting a breakout based on the second score.

Moreover, in the above-described breakout prediction method according to the present invention, the influence coefficient vector is a sensitivity coefficient vector having a sensitivity coefficient of each of the plurality of thermometers as a component.

Moreover, an operation method of a continuous casting machine according to the present invention includes reducing a casting speed at which molten steel is poured into the mold when a breakout is predicted based on the breakout prediction method according to the above-described invention.

Moreover, a breakout prediction device according to the present invention includes: an input unit configured to input a dimension of a solid product withdrawn from a mold in a continuous casting machine; a plurality of thermometers embedded in the mold and configured to detect a temperature of the mold; an interpolation processing execution unit configured to execute interpolation processing on the detected temperatures detected by the plurality of thermometers according to the dimension of the solid product; a degree-of-deviation calculation unit configured to calculate, based on the temperatures calculated by executing the interpolation processing, a component in a direction orthogonal to an influence coefficient vector obtained by principal component analysis as a degree of deviation from during a normal operation in which a breakout has not occurred; and a breakout prediction unit configured to predict a breakout based on the degree of deviation.

Advantageous Effects of Invention

The breakout prediction method, the operation method of the continuous casting machine, and the breakout prediction device according to the present invention have an effect capable of accurately predicting a breakout.

BRIEF DESCRIPTION OF DRAWINGS

FIG. 3(*b*) is a diagram illustrating a state of a fractured portion of the solidified shell in the sign phenomenon of breakout.

FIG. 4(*b*) is a diagram illustrating the temperature distribution of the mold after 10 seconds from the moment when a seizure has occurred.

FIG. 8(*a*) is a diagram illustrating a relationship between the detected temperatures of the thermometers and the temperatures at which the interpolation processing has been executed in a case where the width of the solid product withdrawn from the lower end of the mold is wide.

FIG. 8(*b*) is a diagram illustrating a relationship between the detected temperatures of the thermometers and the temperatures at which the interpolation processing has been executed in a case where the width of the solid product withdrawn from the lower end of the mold is narrow.

FIG. 10(*b*) is a diagram illustrating a time-series change in the time change rate of the degree of deviation in the case where a seizure has occurred.

FIG. 11(*b*) is a diagram illustrating a time-series change in the time change rate of the degree of deviation in the case where a seizure has not occurred.

FIG. 13 is a diagram illustrating a determination method of determining that the condition of adjacency is satisfied when the calculation cells are arranged in two stages of upper and lower stages in the casting direction, and a score is acquired in a calculation cell corresponding to three adjacent points in the upper-stage calculation cells and one of the three adjacent points of the upper-stage calculation cells in the lower-stage calculation cells.

DESCRIPTION OF EMBODIMENTS

Embodiments of a breakout prediction method, an operation method of a continuous casting machine, and a breakout prediction device according to the present invention will be described below. Note that the present invention is not limited by the embodiments.

Figure 1:
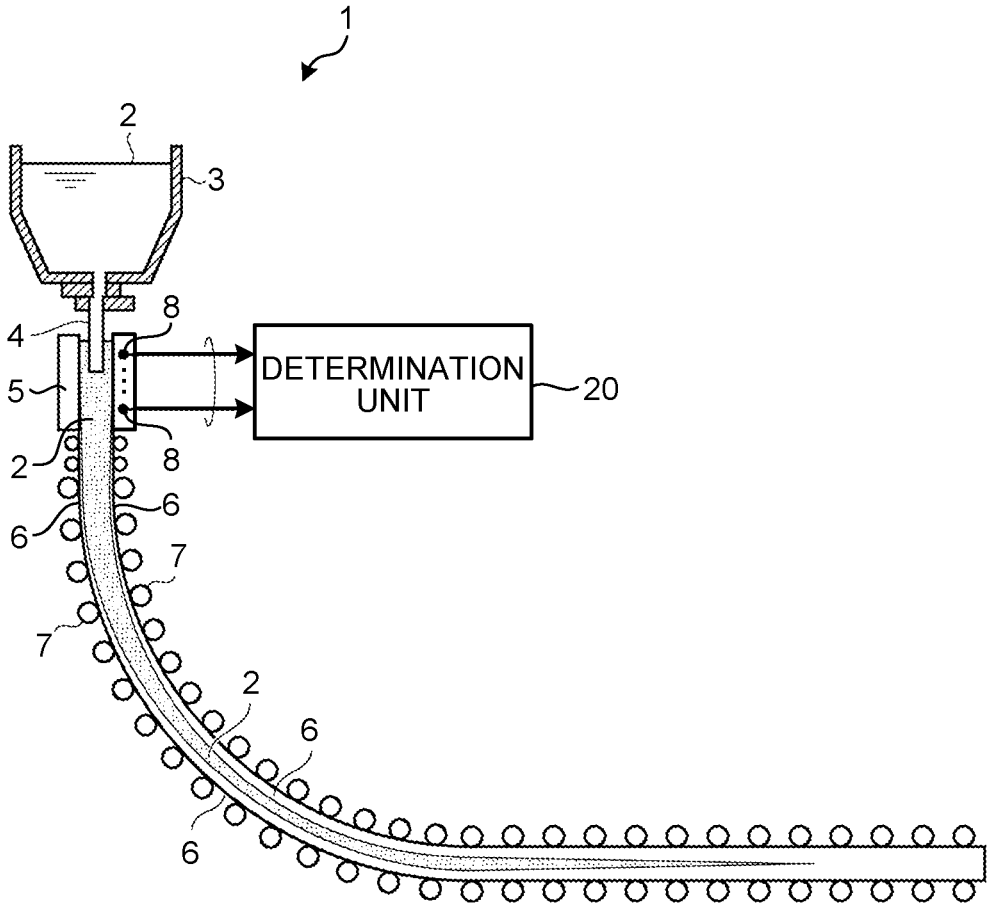
FIG. 1 is a schematic diagram illustrating a schematic configuration of a continuous casting machine according to an embodiment.

FIG. 1 is a schematic diagram illustrating a schematic configuration of a continuous casting machine 1 according to the embodiment. As illustrated in FIG. 1, the continuous casting machine 1 according to the embodiment includes a tundish 3 into which molten steel 2 is poured, a copper mold 5 that cools the molten steel 2 poured from the tundish 3 through an immersion nozzle 4, a plurality of solid product support rolls 7 that conveys a semi-solidified solid product 6 withdrawn from the mold 5, and a determination unit 20 that determines a sign phenomenon of breakout from a detected temperature of a thermometer 8 embedded in the mold 5. Note that the present embodiment uses a thermocouple as the thermometer 8 but is not limited thereto.

Figure 2:
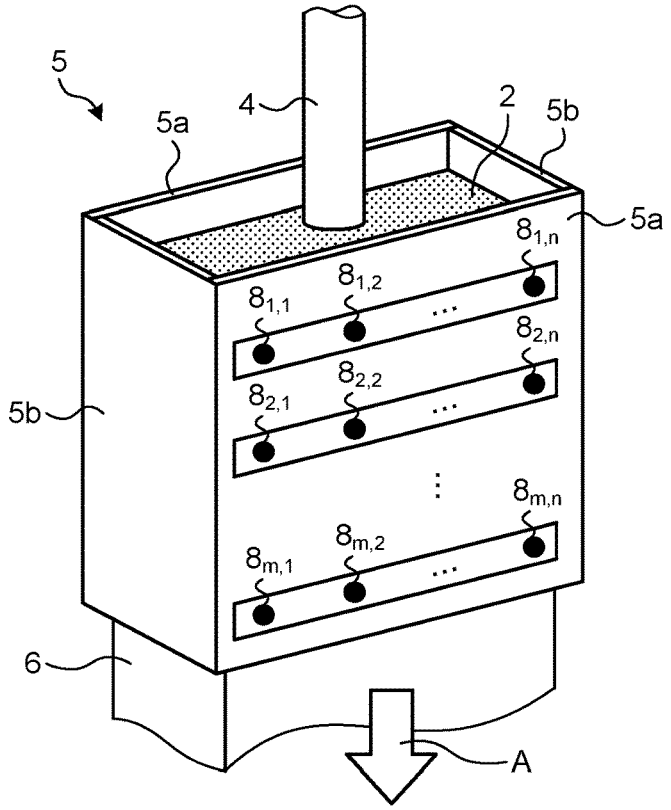
FIG. 2 is a perspective view illustrating a schematic configuration of a mold in which a thermometer is embedded, in the continuous casting machine according to the embodiment.

FIG. 2 is a perspective view illustrating a schematic configuration of the mold 5 in which thermometers $\mathbf{8}_{1,1}$ to $\mathbf{8}_{m,n}$ are embedded, in the continuous casting machine 1 according to the embodiment. As illustrated in FIG. 2, the mold 5 includes a pair of long-side cooling plates 5*a* and a pair of short-side cooling plates 5*b*, and is formed in a substantially rectangular tubular shape penetrating in the vertical direction. A cooling water channel not illustrated is formed along the inner wall surface within the long-side cooling plate 5*a* and the short-side cooling plate 5*b*, and cooling water is circulated in the cooling water channel to cool the molten steel 2.

The thermometers $\mathbf{8}_{1,1}$ to $\mathbf{8}_{m,n}$ are embedded within the long-side cooling plate 5*a* of the mold 5 at a predetermined depth from the outer wall surface of the long-side cooling plate 5*a*. Note that, in the following description, when the thermometers $\mathbf{8}_{1,1}$ to $\mathbf{8}_{m,n}$ are not particularly distinguished from each other, the thermometers are also referred to simply as thermometers 8. In FIG. 2, the thermometers $\mathbf{8}_{1,1}$ to $\mathbf{8}_{m,n}$ are arranged in three or more stages in a casting direction A, and first-stage thermometers $\mathbf{8}_{1,1}$ to $\mathbf{8}_{1,n}$, second-stage thermometers $\mathbf{8}_{2,1}$ to $\mathbf{8}_{2,n}$, and n-th-stage thermometers $\mathbf{8}_{m,1}$ to $\mathbf{8}_{m,n}$ are separately embedded on the same plane. In the present embodiment, the casting direction A is a direction in which the molten steel 2 is poured into the mold 5 from the tundish 3 through the immersion nozzle 4, and is the same direction as a direction in which the solid product 6 is withdrawn from the lower end of the mold 5.

Note that the arrangement of the thermometers 8 illustrated in FIG. 2 is merely an example for explaining the present invention, and the thermometers 8 may be arranged on at least one of the pair of long-side cooling plates 5*a*, at least one of the pair of short-side cooling plates 5*b*, or all of the pair of long-side cooling plates 5*a* and the pair of short-side cooling plates 5*b* among the pair of long-side cooling plates 5*a* and the pair of short-side cooling plates 5*b* of the mold 5. Of the arrangements described above, it is preferable that thermometers are arranged on all of the pair of long-side cooling plates 5*a* and the pair of short-side cooling plates 5*b*. The thermometers 8 can also be arranged in the mold 5 in a multi-stage arrangement of more than three stages or in a single-stage arrangement in the casting direction A.

Figure 3:
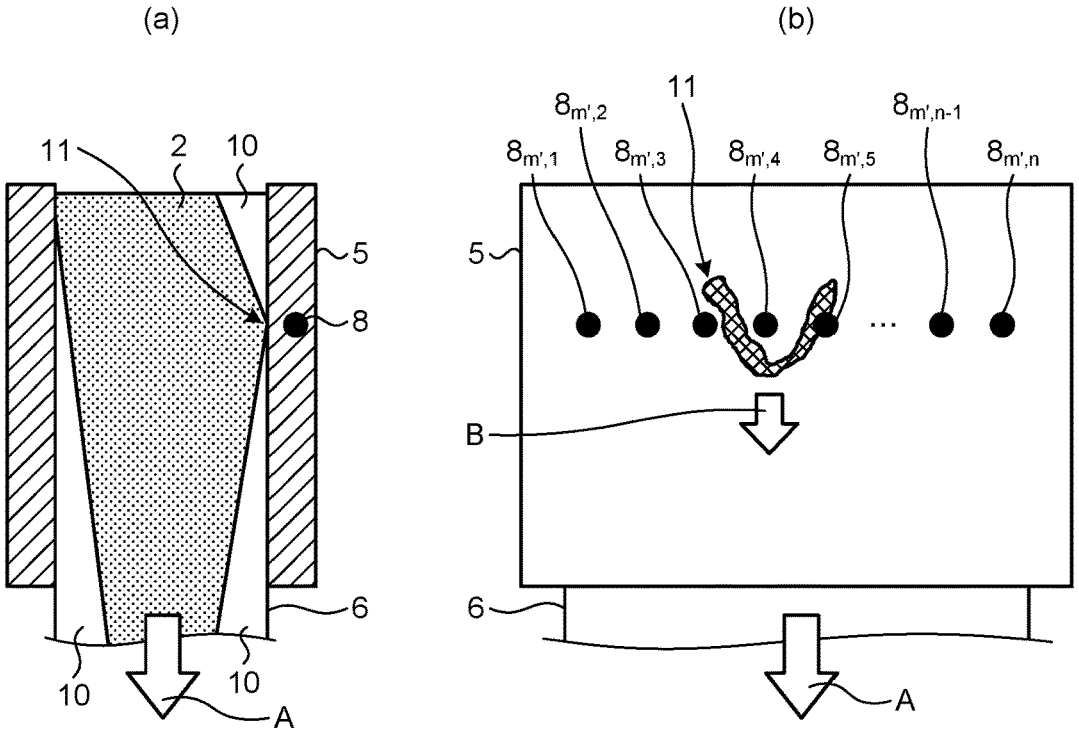
FIG. 3(*a*) is a diagram for explaining the state of the molten steel and the solidified shell in the mold in a sign phenomenon of breakout.

The sign phenomenon of breakout will now be described. FIG. 3(*a*) is a diagram for explaining the state of the molten steel 2 and a solidified shell 10 in the mold 5 in a sign phenomenon of breakout. FIG. 3(*b*) is a diagram illustrating a state of a fractured portion 11 of the solidified shell 10 in the sign phenomenon of breakout.

As illustrated in FIGS. 3(*a*) and 3(*b*), in the sign phenomenon of breakout, a seizure occurs in the mold 5 due to some factor, and the solidified shell 10 is stuck by the mold 5. On the other hand, since the solid product 6 is withdrawn from the lower end of the mold 5 in the same direction as the casting direction A illustrated in FIG. 3(*b*), the fractured portion 11 of the solidified shell 10 is generated directly under the seizure. At the fractured portion 11 of the solidified shell 10, the mold 5 and the molten steel 2 come into contact with each other, and further seizure occurs. While the above phenomenon is repeated, the fractured portion 11 of the solidified shell 10 moves downward, and the solidified shell 10 above the fractured portion 11 becomes thicker. Finally, when the fractured portion 11 passes through the lower end of the mold 5, the molten steel 2 leaks from the fractured portion 11 and a breakout occurs.

Note that the molten steel 2 and the mold 5 are in contact with each other at the fractured portion 11, and thus the temperature of the mold 5 locally rises. Therefore, for example, as indicated by an arrow B in FIG. 3(*b*), when the fractured portion 11 moving downward passes through the arrangement positions of thermometers $\mathbf{8}_{m',1}$ to $\mathbf{8}_{m',n}$, the detected temperatures of the thermometers $\mathbf{8}_{m',1}$ to $\mathbf{8}_{m'n}$ become high. Then solidified shell 10 above the fractured portion 11 is then stuck by the mold 5 and continues to be cooled, and thus the detected temperatures of the thermometers $\mathbf{8}_{m',1}$ to $\mathbf{8}_{m',n}$ monotonically decrease. On the other hand, since the fractured portion 11 is propagated not only in the downward direction but also in the lateral direction, the fractured portion 11 expands in a V-shape as illustrated in FIG. 3(*b*). Note that, when the fractured portion 11 of the solidified shell 10 occurs at a position lower than the thermometers $\mathbf{8}_{m',1}$ to $\mathbf{8}_{m',n}$, the passage through the fractured portion 11 does not occur at the positions of the thermometers $\mathbf{8}_{m',1}$ to $\mathbf{8}_{m',n}$, and thus only a decrease in the detected temperatures of the thermometers $\mathbf{8}_{m',1}$ to $\mathbf{8}_{m',n}$ is observed.

Figure 4:
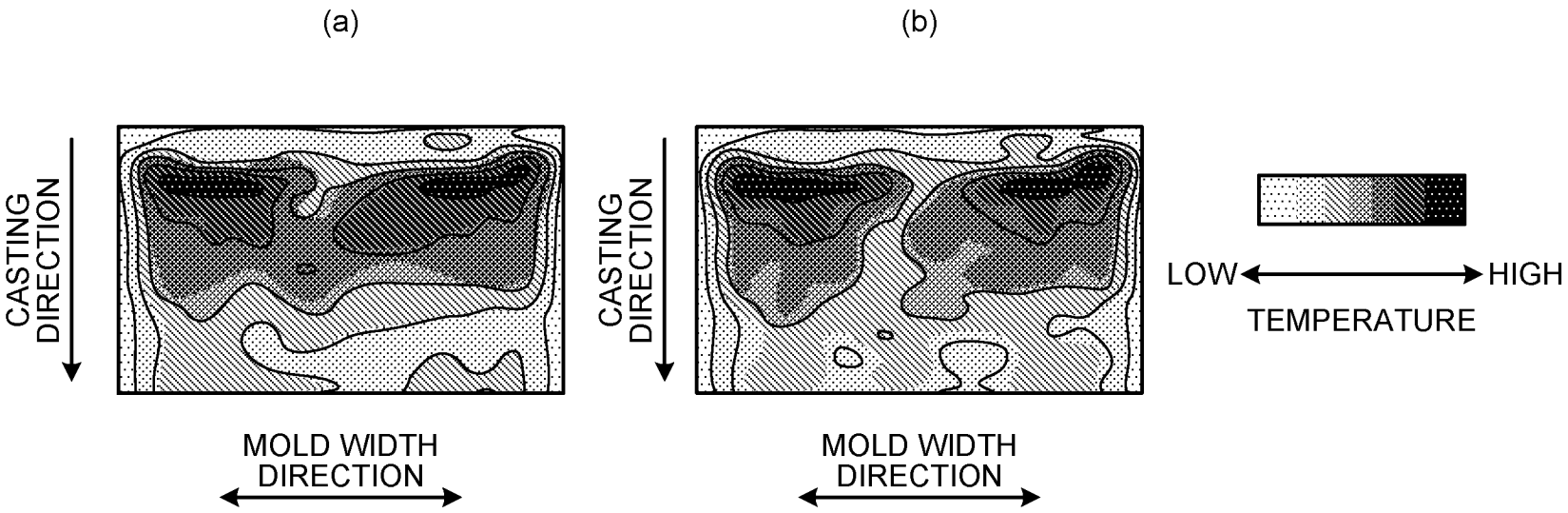
FIG. 4(*a*) is the temperature distribution of the mold at a moment when a seizure has occurred.

FIG. 4(*a*) is the temperature distribution of the mold 5 at a moment when a seizure has occurred. FIG. 4(*b*) is a diagram illustrating the temperature distribution of the mold 5 after 10 seconds from the moment when a seizure has occurred. From the temperature distributions of the mold 5 illustrated in FIGS. 4(*a*) and 4(*b*), respectively, it can be seen that the V-shaped high temperature portion is propagated in the downward direction and the lateral direction.

The change in the temperature distribution of the mold 5 as described above can also be caused by a decrease in the casting speed, fluctuations in the molten metal surface level, and a change in the width of the solid product 6, for example. In the case of a decrease in the casting speed or fluctuations in the molten metal surface level, the mold temperature located at the same distance from the upper end of the mold 5 changes synchronously. On the other hand, in the case where the casting width at the time of pouring the molten steel 2 into the mold 5 during operation, in other words, the width of the solid product 6 withdrawn from the lower end of the mold 5 is changed, the fluctuation of the mold temperature measured by the thermometers 8 positioned in the vicinity of both ends of the width of the solid product 6 becomes large.

Therefore, in the breakout prediction method according to the embodiment, the evaluation value of the non-interlocking property of the estimated temperature at a plurality of locations where the interpolation processing has been executed according to the width of the solid product 6 is calculated, and the change rate of the evaluation value and the adjacency of the temperature change at the changed location are determined, thereby improving the prediction accuracy of the breakout. The breakout prediction method according to the embodiment based on the above technical concept will be described in detail below.

Figure 5:
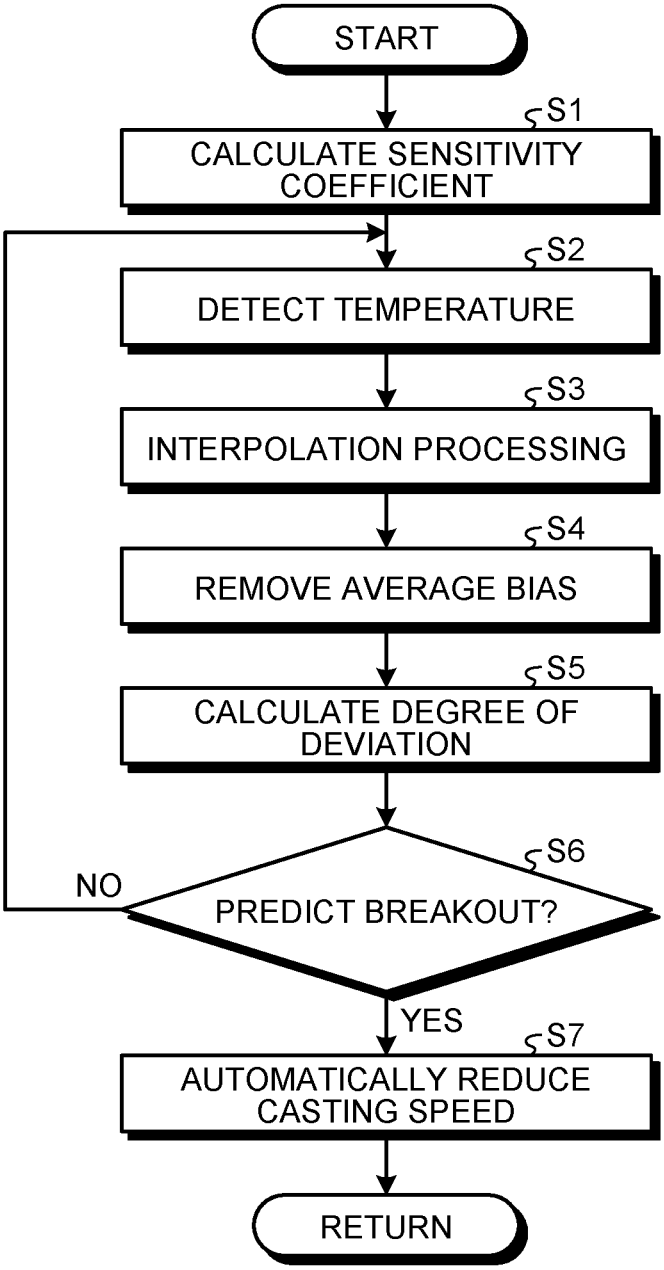
FIG. 5 is a flowchart illustrating an example of a procedure of a breakout prediction method according to the embodiment.

FIG. 5 is a flowchart illustrating an example of a procedure of the breakout prediction method according to the embodiment. The breakout prediction method illustrated in the flowchart is performed by the determination unit 20 illustrated in FIG. 1. Note that the determination unit 20 has at least the functions of an interpolation processing execution means, a degree-of-deviation calculation means, and a breakout prediction means in the present invention. Details of each step in FIG. 5 will be described below as appropriate.

In the breakout prediction method according to the embodiment, the determination unit 20 calculates in advance sensitivity coefficients for the thermometers $\mathbf{8}_{1,1}$ to $\mathbf{8}_{m,n}$ during normal operation (hereinafter also referred to as a normal state) in which a breakout has not occurred (step S1). This sensitivity coefficient is calculated by using a temperature obtained by interpolation processing with a normal temperature actually measured by a thermometer as a reference such that the sensitivity coefficient can cope with a casting having a different width or failure of the thermometer as will be described below. Note that, since there is a possibility that the sensitivity coefficient changes due to a change in the surface state of the mold 5 through the operation, it is preferable to update the sensitivity coefficient at an appropriate time such as between castings. The determination unit 20 then continuously detects temperatures $T_{1,1}$ to $T_{m,n}$ of the mold 5 using the thermometers $\mathbf{8}_{1,1}$ to $\mathbf{8}_{m,n}$ (step S2). The determination unit 20 then executes the interpolation processing of the temperature of the mold 5 on the detected temperatures of the thermometers $\mathbf{8}_{1,1}$ to $\mathbf{8}_{m,n}$, at the center points of calculation cells $\mathbf{12}_{1,1}$ to $\mathbf{12}_{k,p}$ equally divided according to the dimensions of the solid product 6 to be withdrawn from the mold 5 (e.g., widths of the solid product 6 and thicknesses of the solid product 6) input by an operator through an input device not illustrated which is an input means such as a personal computer provided in the continuous casting machine 1 (step S3). Average bias removal is then performed on the temperatures $T'_{1,1}$ to $T'_{k,p}$ of the mold 5 obtained by the interpolation processing. In other words, in the temperatures $T'_{1,1}$ to $T'_{k,p}$ of the mold 5 obtained by the interpolation processing, the average values are obtained for the temperatures $T'_{1,1}$ to $T'_{1,p}$ of the calculation cells $\mathbf{12}_{1,1}$ to $\mathbf{12}_{1,p}$ and the temperatures $T'_{2,1}$ to $T'_{2,p}$ and $T'_{k,1}$ to $T'_{k,p}$ of the calculation cells $\mathbf{12}_{2,1}$ to $\mathbf{12}_{2,p}$, respectively, at the same distance from the upper end of the mold 5. The difference from the average value of the temperatures $T'_{1,1}$ to $T'_{1,p}$ of the calculation cells $\mathbf{12}_{1,1}$ to $\mathbf{12}_{1,p}$ and the difference from the average value of the temperatures $T'_{2,1}$ to $T'_{2,p}$ of the calculation cells $\mathbf{12}_{2,1}$ to $\mathbf{12}_{2,p}$ are then obtained (step S4). The determination unit 20 then calculates the degree of deviation from the difference from the obtained average value using the sensitivity coefficient (step S5).

The sensitivity coefficient vector, which is a vector having the sensitivity coefficients, which are influence coefficients, as components, represents a direction indicating an average behavior of the temperatures of the calculation cells obtained by the above interpolation processing for the thermometers $\mathbf{8}_{1,1}$ to $\mathbf{8}_{m,n}$ during normal operation. In the vector having the difference from the average value as a component, a component parallel to the direction of the sensitivity coefficient vector is a component of the average behavior, and a component in a direction orthogonal to the direction of the sensitivity coefficient vector is a component of the degree of deviation from the average behavior.

When the calculated time rate of change of the degree of deviation exceeds the threshold Y, the determination unit 20 then determines a breakout prediction based on the adjacent state of the calculation cell 12 whose absolute degree of deviation exceeds the threshold X (step S6). Note that the time change rate of the degree of deviation represents a rate (degree) at which the absolute value of the degree of deviation changes in a predetermined time (per unit time). If it is determined that the breakout is not predicted (No in step S6), the determination unit 20 proceeds to step S2. On the other hand, if it is determined that the breakout has been predicted (Yes in step S6), the determination unit 20 automatically reduces the casting speed to a predetermined speed (step S7). As described above, when the determination unit 20 predicts the breakout, the casting speed is sufficiently reduced, so that the solidified shell 10 having a sufficient thickness is formed in the mold 5 even at the location where a seizure occurs, and thus the breakout can be avoided. The determination unit 20 reduces the casting speed to a predetermined value, and then returns the processing routine.

Figure 6:
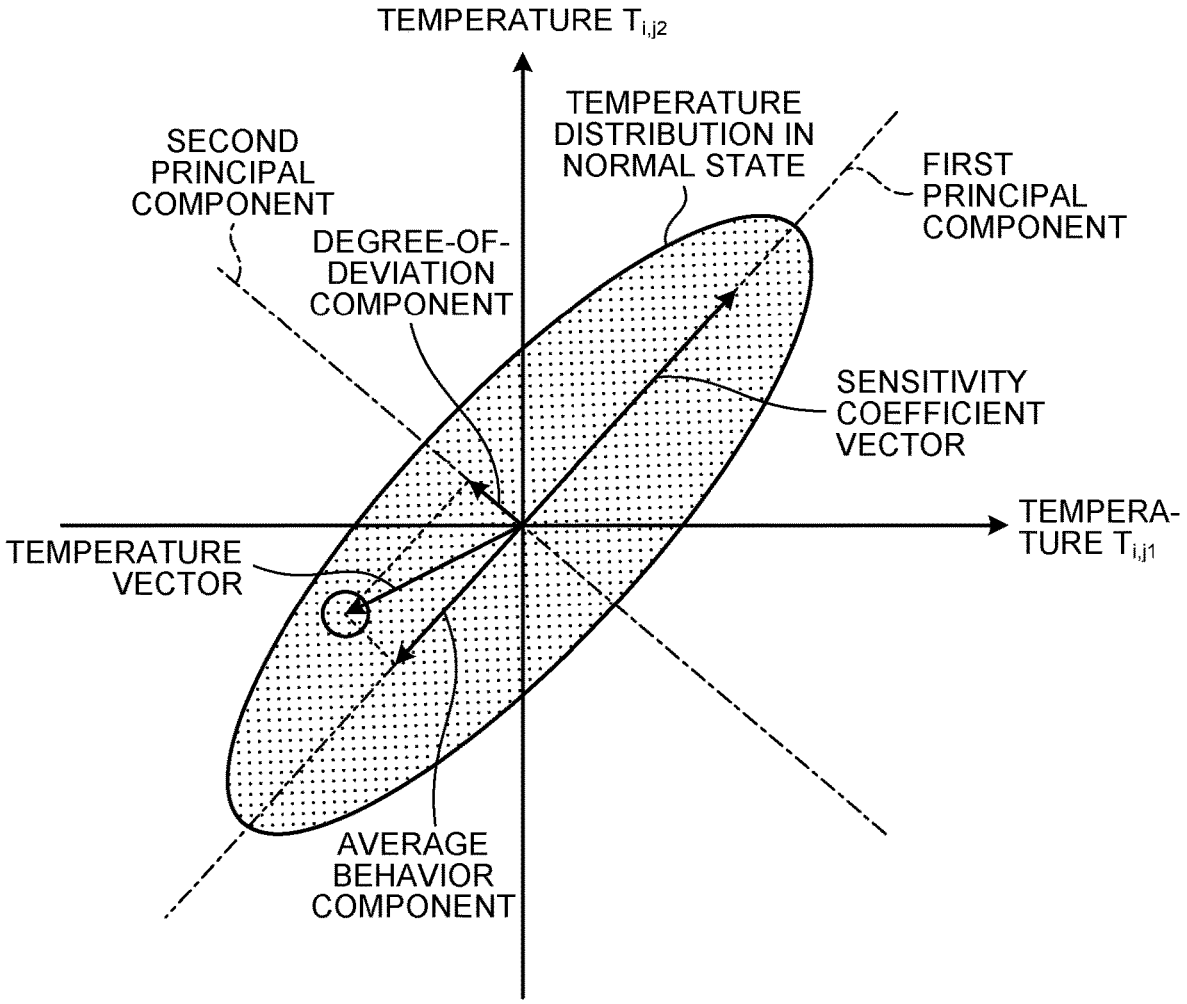
FIG. 6 is a diagram illustrating a correlation between detected temperatures of thermometers in a normal state in which a breakout does not occur.
Figure 7:
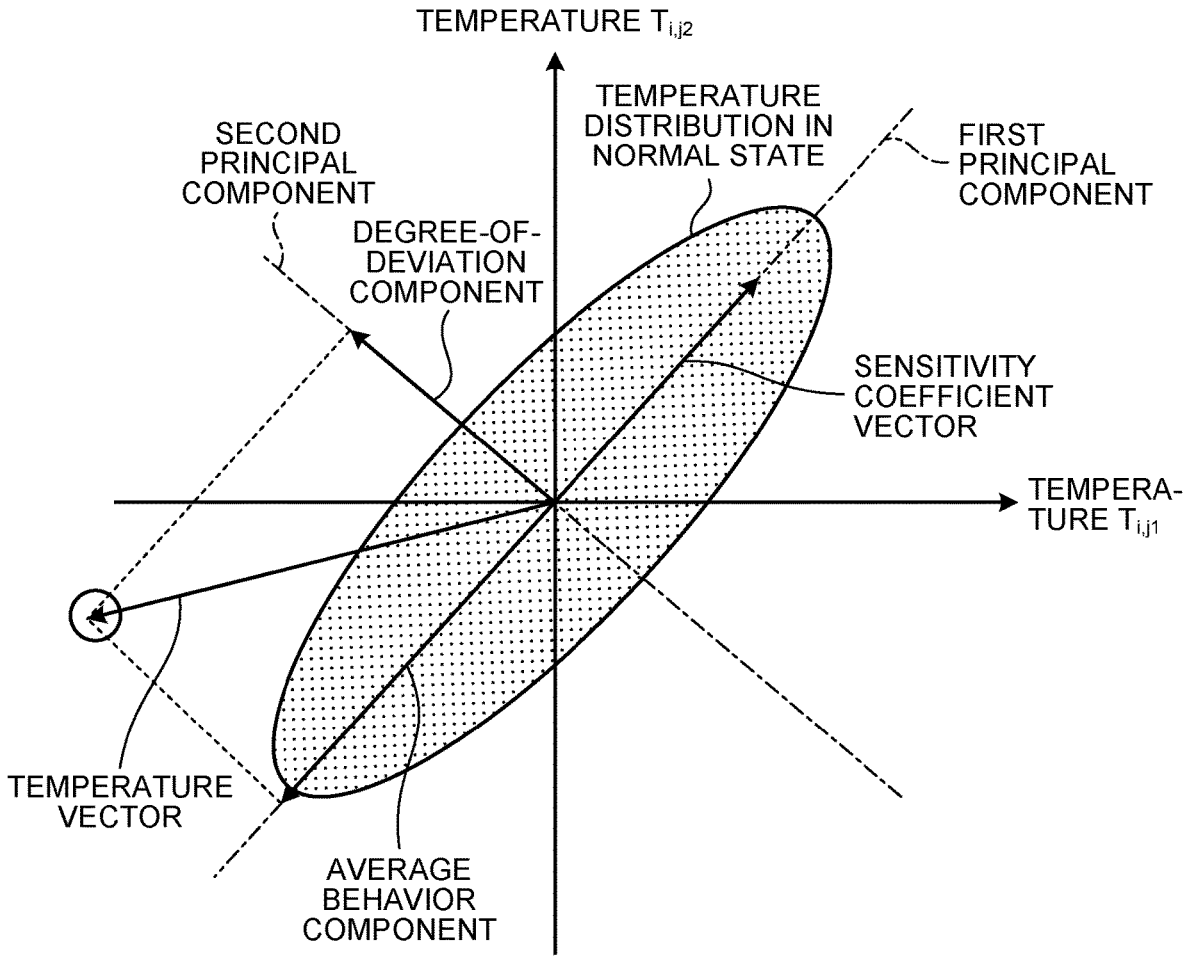
FIG. 7 is a diagram illustrating a correlation between the detected temperatures of the thermometers when a sign such as seizure leading to breakout occurs.

The sensitivity coefficient used in the breakout prediction method according to the embodiment will now be described with respect to a case where the detected temperatures of the thermometers $\mathbf{8}_{1,1}$ to $\mathbf{8}_{m,n}$ are used first. FIG. 6 is a diagram illustrating a correlation between the detected temperatures of the thermometers $\mathbf{8}_{1,1}$ to $\mathbf{8}_{m,n}$ in a normal state in which a breakout does not occur. FIG. 7 is a diagram illustrating a correlation between the detected temperatures of the thermometers $\mathbf{8}_{1,1}$ to $\mathbf{8}_{m,n}$ when a sign such as seizure leading to breakout occurs. Note that, for the sake of simplicity, FIGS. 6 and 7 illustrate the case of two thermometers $\mathbf{8}_{i,j1}$ and $\mathbf{8}_{i,j2}$ located at the same distance from the upper end of the mold 5 in the casting direction A.

As illustrated in FIG. 6, the detected temperatures of the thermometer $\mathbf{8}_{i,j1}$ and the thermometer $\mathbf{8}_{i,j2}$ in the normal state are distributed in a range close to a broken line (a line inclined at 45 degrees to the right in the example illustrated in FIG. 6) indicating the direction of a sensitivity coefficient vector which is a vector having a sensitivity coefficient as a component. When the detected temperature $T_{i,j1}$ detected by the thermometer $\mathbf{8}_{i,j1}$ increases, the detected temperature $T_{i,j2}$ detected by the thermometer $\mathbf{8}_{i,j2}$ also increases. On the other hand, when the detected temperature $T_{i,j1}$ detected by the thermometer $\mathbf{8}_{i,j1}$ decreases, the detected temperature $T_{i,j2}$ detected by the thermometer $\mathbf{8}_{i,j2}$ also decreases.

As described above, the reason why the thermometer $\mathbf{8}_{i,j1}$ and the thermometer $\mathbf{8}_{i,j2}$ have a correlation in the normal state is as follows. For example, when the casting speed of the continuous casting machine 1 is higher, the solid product 6 is withdrawn before the solidified shell 10 sufficiently grows, and thus the solidified shell 10 becomes thinner. As a result, the thermal resistance decreases and the temperature of the molten steel 2 is easily transmitted to the thermometer $\mathbf{8}_{i,j1}$ and the thermometer $\mathbf{8}_{i,j2}$. On the other hand, as the casting speed is slower, the solidified shell 10 is withdrawn after the solidified shell sufficiently grows, so that the solidified shell 10 becomes thicker and the thermal resistance increases, and the temperature of the molten steel 2 is hardly transmitted to the thermometer $\mathbf{8}_{i,j1}$ and the thermometer $\mathbf{8}_{i,j2}$. Since these tendencies are common to all the thermometers $\mathbf{8}_{1,1}$ to $\mathbf{8}_{m,n}$, the detected temperatures of the thermometers $\mathbf{8}_{1,1}$ to $\mathbf{8}_{m,n}$ in the normal state are distributed in a range close to the broken line indicating the direction of the sensitivity coefficient vector in a shape close to an ellipse. However, the sensitivity coefficients of the thermometers $\mathbf{8}_{1,1}$ to $\mathbf{8}_{m,n}$ are generally not constant because how easily the temperature of the molten steel 2 is transmitted differs for each of the thermometers $\mathbf{8}_{1,1}$ to $\mathbf{8}_{m,n}$. Therefore, the inclination of the sensitivity coefficient vector illustrated in FIG. 6 may vary depending on the installation locations of the thermometers $\mathbf{8}_{1,1}$ to $\mathbf{8}_{m,n}$ with respect to the mold 5, variations in construction, and others.

The reason why the thermometer $\mathbf{8}_{i,j1}$ and the thermometer $\mathbf{8}_{i,j2}$ have a correlation in the normal state can be considered to be, in addition to the above, the flow of the molten steel 2 in the mold 5, the fluctuations of the molten metal surface, and others. However, most of the sensitivity coefficients of the thermometers $\mathbf{8}_{1,1}$ to $\mathbf{8}_{m,n}$ are contributed by the overall temperature change of the mold 5 accompanying the increase and decrease of the above casting speed. Therefore, in order to take more various phenomena of the continuous casting process into consideration in the sensitivity coefficient, it is necessary to remove the overall temperature change of the mold 5 accompanying the increase and decrease of the casting speed as the average bias.

As a method of removing the average bias, for example, there is a method of obtaining an average value $T_{ave}$ of all of the detected temperatures $T_{1,1}$ to $T_{m,n}$ detected by the thermometers $\mathbf{8}_{1,1}$ to $\mathbf{8}_{m,n}$ and obtaining a difference between each of the detected temperatures $T_{1,1}$ to $T_{m,n}$ and the average value $T_{ave}$. As another method of removing the average bias, for example, there is a method of obtaining an average value $T_{i,ave}$ of the detected temperatures $T_{1,i}$ to $T_{i,n}$ detected by the thermometers $\mathbf{8}_{i,1}$ to $\mathbf{8}_{i,n}$ located at the same distance from the upper end of the mold 5 in the casting direction A, and obtaining the difference between each of the detected temperatures $T_{i,1}$ to $T_{i,n}$, and the average value $T_{i,ave}$ for each thermometer 8 located at the same distance.

As one method of obtaining a sensitivity coefficient vector which is an influence coefficient vector, a method of using principal component analysis can be considered. As another method, for example, a method of experimentally obtaining how easily the temperature of the molten steel 2 in each of the thermometers $\mathbf{8}_{1,1}$ to $\mathbf{8}_{m,n}$ is transmitted when the overall temperature changes due to fluctuations in the molten metal surface or others can be considered.

On the other hand, as illustrated in FIG. 7, the detected temperatures of the thermometers $\mathbf{8}_{i,j1}$ and $\mathbf{8}_{i,j2}$ at the time of occurrence of a sign such as seizure leading to breakout are distributed at positions away from a broken line (a line inclined at 45 degrees to the right in the example illustrated in FIG. 7) indicating the direction of the sensitivity coefficient vector. This is because, when a seizure leading to breakout occurs, the detected temperature $T_{i,j1}$ decreases at the thermometer $\mathbf{8}_{i,j1}$ close to the position of the fractured portion 11 of the solidified shell 10, and a detected temperature $T_{i,j1+1}$ and a detected temperature $T_{i,j1-1}$ of a thermometer $\mathbf{8}_{i,j1+1}$ and a thermometer $\mathbf{8}_{i,j1-1}$, which are located on both sides of the thermometer $\mathbf{8}_{i,j1}$, decrease after a short delay.

From the above consideration, it can be seen that the occurrence of breakout can be determined based on the degree of deviation of the detected temperatures $T_{1,1}$ to $T_{m,n}$ of the thermometers $\mathbf{8}_{1,1}$ to $\mathbf{8}_{m,n}$ from the broken line indicating the direction of the sensitivity coefficient vector. In other words, it can be seen that the components in the direction orthogonal to the sensitivity coefficient vector in the temperature vector which is a vector having the detected temperatures $T_{1,1}$ to $T_{m,n}$ of the thermometers $\mathbf{8}_{1,1}$ to $\mathbf{8}_{m,n}$ as components are calculated as the degree of deviation, and the occurrence of breakout can be determined based on the degree of deviation.

For example, in FIGS. 6 and 7, the degree-of-deviation component which is components in a direction orthogonal to the sensitivity coefficient vector is calculated in the temperature vectors having the detected temperatures of the thermometer $\mathbf{8}_{i,j1}$ and the thermometer $\mathbf{8}_{i,j2}$ as components. The occurrence of breakout is determined based on the calculated degree-of-deviation component. Note that, in FIGS. 6 and 7, the direction of the sensitivity coefficient vector is the same as the direction of the first principal component of the temperature distribution in the normal state, and the direction orthogonal to the direction of the sensitivity coefficient vector is the same as the direction of the second principal component of the temperature distribution in the normal state.

However, if the detected temperatures $T_{1,1}$ to $T_{m,n}$ themselves are used for prediction of breakout, there is a possibility that the occurrence of breakout is erroneously predicted (erroneously detected) in a non-steady state such as when the casting width at the time of pouring the molten steel 2 into the mold 5, in other words, the width of the solid product 6 withdrawn from the lower end of the mold 5 is changed during operation, even though a sign leading to breakout has not occurred.

FIG. 8(*a*) is a diagram illustrating a relationship between detected temperatures $T_{m1,n1}$ to $T_{m1,n1+18}$ of thermometers $\mathbf{8}_{m1,n1}$ to $\mathbf{8}_{m1,n1+18}$ and temperatures $T'_{m1,n1}$ to $T'_{m1,n1+18}$ at which the interpolation processing has been executed in a case where the width (casting width) of the solid product 6 withdrawn from the lower end of the mold 5 is wide. FIG. 8(*b*) is a diagram illustrating a relationship between detected temperatures $T_{m1,n1}$ to $T_{m1,n1+18}$ of thermometers $\mathbf{8}_{m1,n1}$ to $\mathbf{8}_{m1,n1+18}$ and temperatures $T'_{m1,n1}$ to $T'_{m1,n1+18}$ at which the interpolation processing has been executed in a case where the width (casting width) of the solid product 6 withdrawn from the lower end of the mold 5 is narrow. Note that, in FIGS. 8(*a*) and 8(*b*), the thermometers $\mathbf{8}_{m1,n1}$ to $\mathbf{8}_{m1,n1+18}$ are arranged at positions at the same distance from the upper end of the mold 5 in the casting direction A. The temperatures $T'_{m1,n1}$ to $T'_{m1,n1+18}$ are estimated temperatures of the mold 5 calculated by executing interpolation processing on the detected temperatures $T_{m1,n1}$ to $T_{m1,n1+18}$ of the thermometers $\mathbf{8}_{m1,n1}$ to $\mathbf{8}_{m1,n1+18}$, at the center points of the calculation cells $\mathbf{12}_{m1,n1}$ to $\mathbf{12}_{m1,n1+18}$ equally divided according to the widths of the solid product 6. Note that an interpolation processing method will be described below.

In the case where the casting width is changed during casting and the state is changed from FIG. 8(*a*) to FIG. 8(*b*), when attention is paid to the detected temperatures $T_{m1,n1}$ to $T_{m1,n1+18}$ of the thermometers $\mathbf{8}_{m1,n1}$ to $\mathbf{8}_{m1,n1+18}$, only a detected temperature $T_{m1,n1+3}$ and a detected temperature $T_{m1,n1+18}$ have a large temperature change, and the other detected temperatures do not have a significant temperature change. Therefore, in the cases illustrated in FIGS. 8(*a*) and 8 (*b*), if the detected temperatures $T_{m1,n1}$ to $T_{m1,n1+18}$ themselves are used for prediction of breakout, there is a possibility that the detected temperatures deviate from the sensitivity coefficient vector and are erroneously detected as occurrence of a sign leading to breakout.

On the other hand, in the case where the casting width is changed during casting and the state is changed from FIG. 8(*a*) to FIG. 8(*b*), when attention is paid to the temperatures $T'_{m1,n1}$ to $T'_{m1,n1+18}$ at which, even when the dimension of the solid product 6 is changed, the number of calculation cells 12 (the number of cells) is kept constant and the interpolation processing has been executed, the temperature change of the temperatures $T'_{m1,n1}$ to $T'_{m1,n1+18}$ is small. Therefore, in the cases illustrated in FIGS. 8(*a*) and 8 (*b*), by using the temperatures $T'_{m1,n1}$ to $T'_{m1,n1+18}$ at which interpolation processing has been executed for prediction of breakout, it is possible to reduce the risk of erroneous detection of occurrence of a sign leading to breakout.

In FIGS. 8(*a*) and 8(*b*), the temperature detection of a thermometer $\mathbf{8}_{m1,n1+7}$, a thermometer $\mathbf{8}_{m1,n1+11}$, a thermometer $\mathbf{8}_{m1,n1+12}$, and a thermometer $\mathbf{8}_{m1,n1+16}$ that detect a detected temperature $T_{m1,n+7}$, a detected temperature $T_{m1,n1+11}$, a detected temperature $T_{m1,n1+12}$, and a detected temperature $T_{m1,n1+16}$, respectively, is defective. Even in the case of including the thermometer 8 whose temperature detection is defective as described above, if the detected temperatures $T_{m1,n1}$ to $T_{m1,n1+18}$ themselves are used for prediction of breakout, there is a possibility that the detected temperatures deviate from the sensitivity coefficient vector and are erroneously detected as a sign of breakout occurrence. On the other hand, at the temperatures $T'_{m1,n1}$ to $T'_{m1,n1+18}$ at which the interpolation processing has been executed, even when the thermometer 8 whose temperature detection is defective is included, the risk of erroneous detection of occurrence of a sign leading to breakout can be reduced by using the estimated temperature of the mold 5 in the section where the temperature detection is defective.

Figure 9:
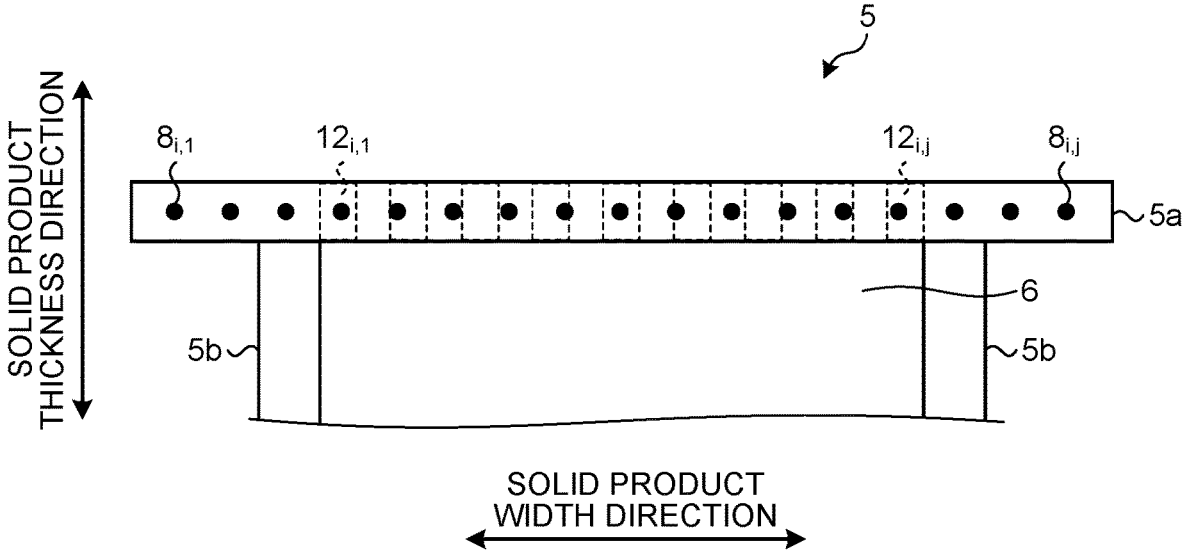
FIG. 9 is a diagram illustrating a positional relationship between the thermometers and calculation cells located at the same distance from the upper end of the mold.

The interpolation processing method will now be described. FIG. 9 is a diagram illustrating a positional relationship between the thermometers $\mathbf{8}_{i,1}$ to $\mathbf{8}_{i,j}$ and calculation cells $\mathbf{12}_{i,1}$ to $\mathbf{12}_{ij}$ located at the same distance from the upper end of the mold 5.

As illustrated in FIG. 9, the calculation cells $\mathbf{12}_{i,1}$ to $\mathbf{12}_{i,j}$ are obtained by equally dividing a section (a section sandwiched between the pair of short-side cooling plates 5*b* in the width direction of the mold 5) corresponding to the width of the solid product 6 in the long-side cooling plate 5*a* by a constant number of cells with respect to the thermometers $\mathbf{8}_{i,1}$ to $\mathbf{8}_{i,j}$ located at the same distance from the upper end of the mold 5 in the long-side cooling plate 5*a* of the mold 5. The detected temperatures detected by the thermometers $\mathbf{8}_{i,1}$ to $\mathbf{8}_{i,j}$ are linearly interpolated to calculate the estimated temperature of the mold 5 (long-side cooling plate 5*a*) at the position of the center point of each of the calculation cells $\mathbf{12}_{i,1}$ to $\mathbf{12}_{i,j}$. Note that the number of calculation cells 12 for the interpolation processing may be the same as or different from the number of thermometers 8 in the vertical and horizontal directions, but is constant regardless of fluctuations in the casting width during casting.

The interpolation processing described above can be applied to a case where the sensitivity coefficient vector is obtained by using the principal component analysis and a case where the degree of deviation is calculated. In this case, the principal component analysis is performed using the temperature subjected to interpolation processing instead of the actual detected temperature. Even when the solid product width is changed, the temperature vector having the same number of points can be used, so that the principal component analysis can be performed including data having different widths. Thus, it is not necessary to obtain a different influence coefficient for each width, and the influence coefficient vector can be determined including data having different solid product widths. The degree of deviation can also be calculated using the influence coefficient vector calculated based on the temperature obtained by interpolating the detected temperature. Therefore, it is possible to predict the breakout of different solid product widths based on a unified standard. Further, even when the solid product width is changed during casting, it is also possible to reduce the risk of erroneous detection related to the occurrence of a sign leading to breakout.

Figure 10:
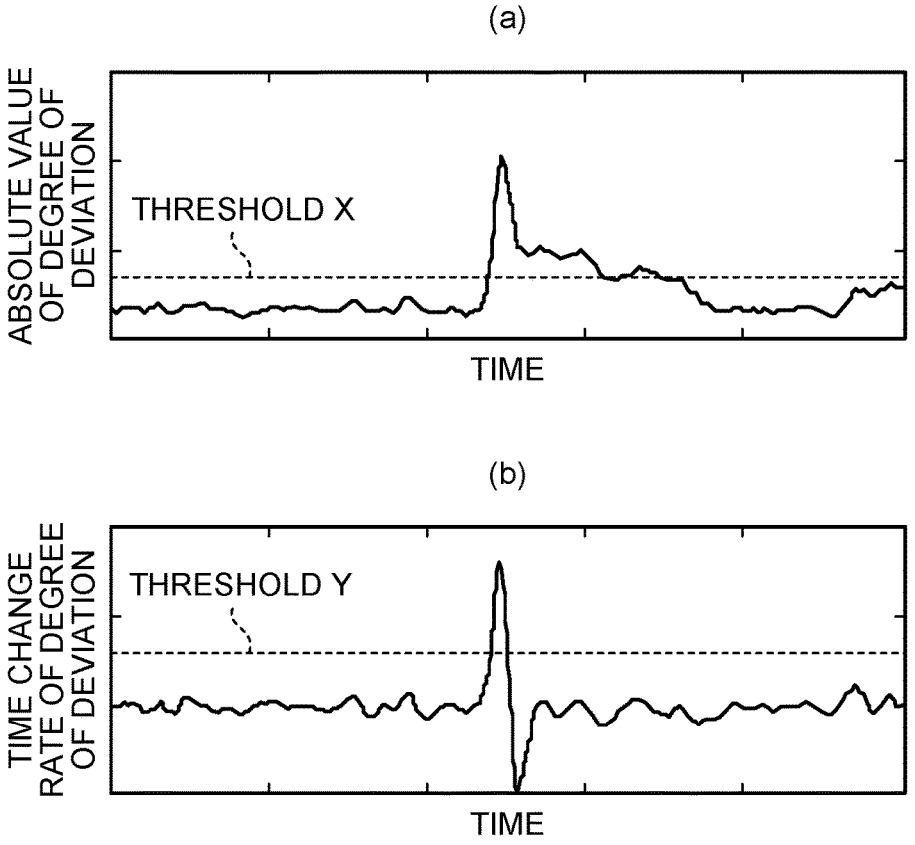
FIG. 10(*a*) is a diagram illustrating a time-series change in an absolute value of a degree of deviation in a case where a seizure has occurred.
Figure 11:
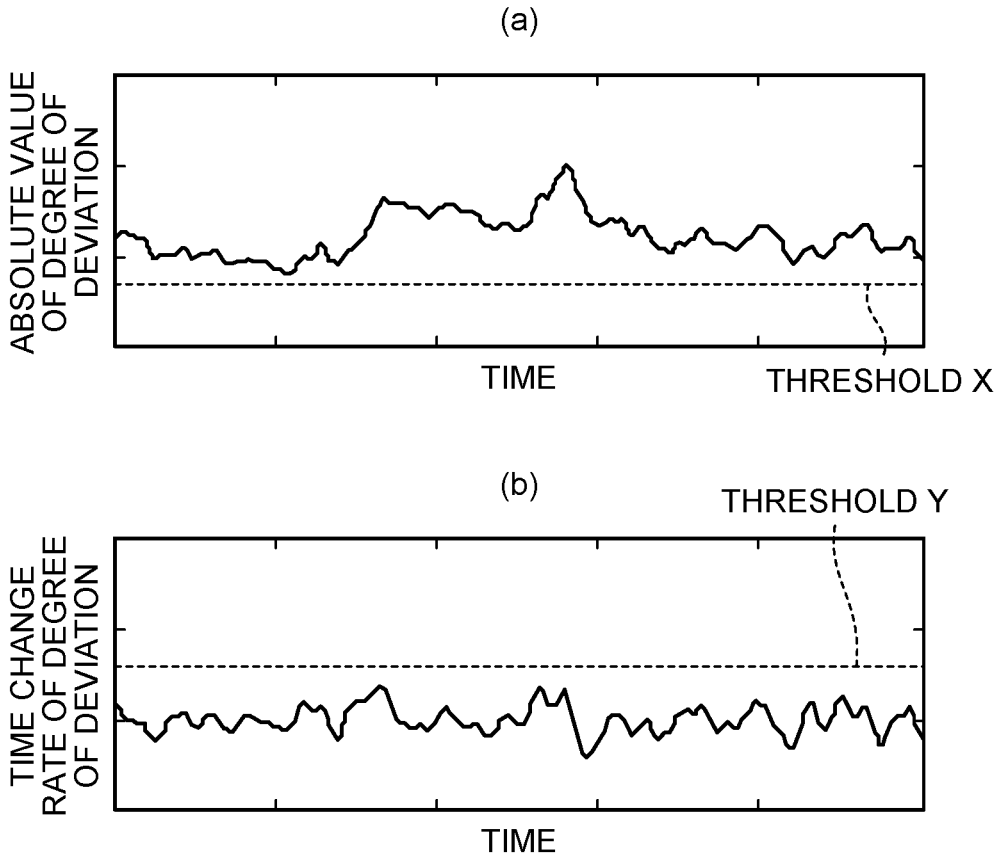
FIG. 11(*a*) is a diagram illustrating a time-series change in the absolute value of the degree of deviation in a case where a seizure has not occurred.

The determination of breakout prediction will now be described. FIG. 10(*a*) is a diagram illustrating a time-series change in the absolute value of the degree of deviation in a case where a seizure has occurred. FIG. 10(*b*) is a diagram illustrating a time-series change in the time change rate of the degree of deviation in the case where a seizure has occurred. FIG. 11(*a*) is a diagram illustrating a time-series change in the absolute value of the degree of deviation in a case where a seizure has not occurred. FIG. 11(*b*) is a diagram illustrating a time-series change in the time change rate of the degree of deviation in the case where a seizure has not occurred.

In FIG. 10(*a*), the absolute value of the degree of deviation rapidly increases at a certain time during operation. On the other hand, in FIG. 11(*a*), the absolute value of the degree of deviation is constantly large during operation. When the sensitivity coefficient calculated based on the temperature subjected to interpolation processing from the detected temperatures of the thermometers $\mathbf{8}_{1,1}$ to $\mathbf{8}_{m,n}$ deviates from a value previously determined due to a factor such as a change in the surface shape of the mold 5, there is a possibility that the absolute value of the degree of deviation is constantly large even if an abnormality such as seizure does not occur as illustrated in FIG. 11(*a*). Therefore, as illustrated in FIGS. 10(*a*) and 11(*a*), when a single threshold X is provided for the absolute value of the degree of deviation, it is difficult to discriminate the presence or absence of the occurrence of seizure which is a sign leading to breakout.

A seizure, which is a sign leading to breakout, suddenly occurs, and the fractured portion 11 of the solidified shell 10 is propagated in the downward and lateral directions of the mold 5. Therefore, as illustrated in FIG. 10(*a*), the absolute value of the degree of deviation when a seizure occurs rapidly increases at a certain time during operation. Therefore, as illustrated in FIG. 10(*b*), the time change rate of the degree of deviation rapidly increases. On the other hand, as illustrated in FIG. 11(*a*), even if an abnormality such as seizure does not occur, when the absolute value of the degree of deviation is constantly large during operation, the time change rate of the degree of deviation does not rapidly increase as illustrated in FIG. 11(*b*). Therefore, as illustrated in FIGS. 10(*b*) and 11(*b*), providing a single threshold Y for the time change rate of the degree of deviation facilitates to discriminate the presence or absence of the occurrence of seizure which is a sign leading to breakout.

A description will now be given of a determination method of determining, when the absolute value of the degree of deviation calculated from the sensitivity coefficient vector exceeds a preset threshold X in a case where the time change rate of the degree of deviation exceeds the threshold Y, the adjacency of the calculation cell 12 having exceeded the threshold X.

Figure 12:
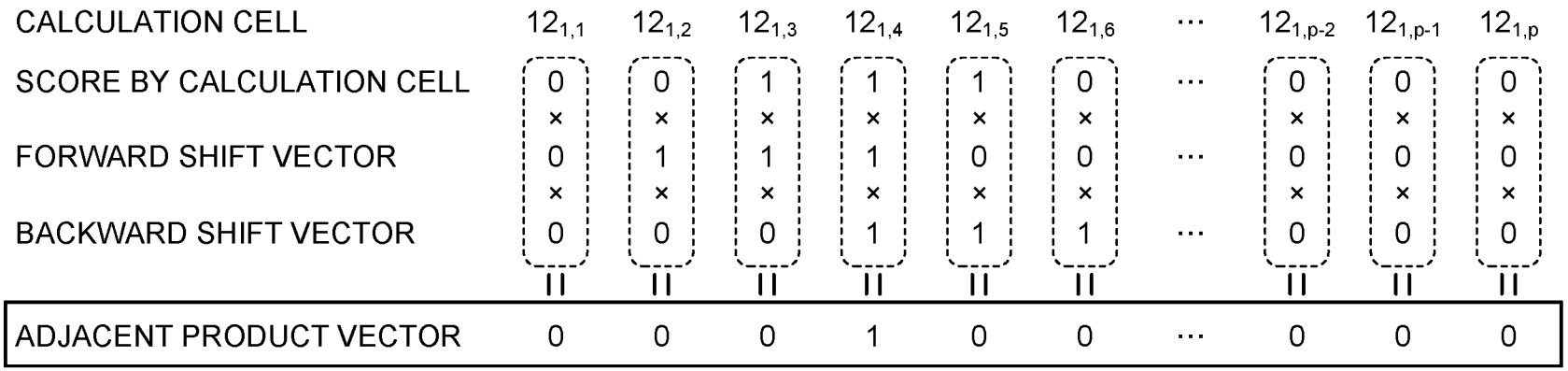
FIG. 12 is a diagram illustrating an example of a determination method of adjacency in a case where the calculation cell that executes the interpolation processing is arranged in one stage.

FIG. 12 is a diagram illustrating an example of a determination method of adjacency in a case where the calculation cell 12 that executes the interpolation processing is arranged in one stage (calculation cells $\mathbf{12}_{1,1}$ to $\mathbf{12}_{1,p}$). In other words, FIG. 12 illustrates an example of a determination method in the lateral adjacency of the calculation cells $\mathbf{12}_{1,1}$ to $\mathbf{12}_{1,p}$ located at the same distance from the upper end of the mold 5 in the casting direction A. Note that, in the determination method of adjacency the present example illustrated in FIG. 12, it is assumed that the time change rate of the degree of deviation exceeds the threshold Y.

In the determination method of adjacency of the present example, first, one point is given as a score by calculation cell, which is a first score, to the calculation cell 12 in which the absolute value of the degree of deviation exceeds the preset threshold X as described above, among the calculation cells $\mathbf{12}_{1,1}$ to $\mathbf{12}_{1,p}$. On the other hand, zero point is given as a score by calculation cell to the calculation cell 12 in which the absolute value of the degree of deviation does not exceed the threshold X, among the calculation cells $\mathbf{12}_{1,1}$ to $\mathbf{12}_{1,p}$. With respect to the vector of the score by calculation cell, a vector obtained by shifting the score by calculation cell to one preceding calculation cell 12 is defined as a forward shift vector, and a vector obtained by shifting the score by calculation cell to one succeeding calculation cell 12 is defined as a backward shift vector. Further, a vector obtained by multiplying the elements of the forward shift vector and the backward shift vector is defined as an adjacent product vector. When the adjacent product vector defined as described above is calculated, if there are three adjacent calculation cells 12 in which the absolute value of the degree of deviation exceeds the threshold X, the score of the central calculation cell 12 of the three adjacent calculation cells 12 is one point, and the score of the other calculation cells 12 is zero point, and this score is define as a second score.

Specifically, referring to the example illustrated in FIG. 12, in FIG. 12, the absolute values of the degrees of deviation of the calculation cell $\mathbf{12}_{1,3}$, the calculation cell $\mathbf{12}_{1,4}$, and the calculation cell $\mathbf{12}_{1,5}$ among the calculation cells $\mathbf{12}_{1,1}$ to $\mathbf{12}_{1,p}$ exceed the set threshold X, so that one points are given to the calculation cell $\mathbf{12}_{1,3}$, the calculation cell $\mathbf{12}_{1,4}$, and the calculation cell $\mathbf{12}_{1,5}$ as a score by calculation cell (first score). On the other hand, zero points are given to the other calculation cell $\mathbf{12}_{1,1}$, the calculation cell $\mathbf{12}_{1,2}$, and the calculation cells $\mathbf{12}_{1,6}$ to $\mathbf{12}_{1,p}$ as a score by calculation cell (first score). A vector in which these scores by calculation cell (first scores) are arranged is (0, 0, 1, 1, 1, 0, . . . , 0, 0, 0). The forward shift vector is (0, 1, 1, 1, 0, 0, . . . , 0, 0, 0) and the backward shift vector is (0, 0, 0, 1, 1, 1, . . . , 0, 0, 0). An adjacent product vector obtained by multiplying the elements of the forward shift vector and the backward shift vector is (0, 0, 0, 1, 0, 0, . . . , 0, 0, 0). Therefore, it can be seen that, when there are three adjacent calculation cells 12 that exceed the threshold X, the score (second score) of the central calculation cell $\mathbf{12}_{1,4}$ of the three adjacent calculation cells $\mathbf{12}_{1,3}$, $\mathbf{12}_{1,4}$, and $\mathbf{12}_{1,5}$ that exceeds the threshold X is one point, and the scores (second scores) of the other calculation cells $\mathbf{12}_{1,1}$ to $\mathbf{12}_{1,3}$ and calculation cells $\mathbf{12}_{1,5}$ to $\mathbf{12}_{1,p}$ are zero points.

Therefore, the determination method of adjacency described with reference to FIG. 12 can determine that a sign such as seizure leading to breakout occurs if any element of the adjacent product vector is 1.

Note that, in FIG. 12, a vector obtained by shifting the score by calculation cell to one preceding calculation cell 12 is defined as a forward shift vector and a vector obtained by shifting the score by calculation cell to one succeeding calculation cell 12 is defined as a backward shift vector, thereby obtaining the adjacent product vector of the three adjacent calculation cells 12, but the determination method is not limited thereto. In other words, according to the set number of cells in the calculation cell 12, a vector obtained by shifting the score by calculation cell to one or more preceding calculation cell 12 may be defined as a forward shift vector and a vector obtained by shifting the score by calculation cell to one or more succeeding calculation cell 12 may be defined as a backward shift vector. Note that, in this case, the number by which the score by calculation cell is shifted to a succeeding calculation cell 12 to obtain a backward shift vector should be the same as the number by which the score by calculation cell is shifted to a preceding calculation cell 12 to obtain a forward shift vector. A vector obtained by multiplying the elements of the forward shift vector and the backward shift vector obtained as described above may be defined as an adjacent product vector.

For example, a vector obtained by shifting the score by calculation cell to three preceding calculation cell 12 is defined as a forward shift vector, and a vector obtained by shifting the score by calculation cell to three succeeding calculation cell 12 is defined as a backward shift vector. It is determined that a sign such as seizure leading to breakout occurs, if any element of the adjacent product vector is 1 by multiplying the elements of the forward shift vector and the backward shift vector and calculating an adjacent product vector of seven adjacent calculation cells 12 to obtain a second score. Thus, the occurrence of a sign leading to breakout can be determined with higher accuracy, and thus the breakout can be predicted with high accuracy.

Further, even when the calculation cells 12 for performing the interpolation processing are configured in two or more stages in the casting direction A, the above determination method of adjacency can be expanded.

FIG. 13 is a diagram illustrating a determination method of determining that the condition of adjacency is satisfied when the calculation cells 12 are arranged in two stages of upper and lower stages (calculation cells $\mathbf{12}_{1,1}$ to $\mathbf{12}_{1,p}$ and calculation cells $\mathbf{12}_{2,1}$ to $\mathbf{12}_{2,p}$) in the casting direction A (vertical direction), and a score is acquired in the calculation cell $\mathbf{12}_{2,i}$ corresponding to three adjacent points in the upper-stage calculation cells $\mathbf{12}_{1,1}$ to $\mathbf{12}_{1,p}$ and one of the three adjacent points of the upper-stage calculation cells in the lower-stage calculation cells $\mathbf{12}_{2,1}$ to $\mathbf{12}_{2,p}$.

The method first determines the adjacency in the upper-stage calculation cells $\mathbf{12}_{1,1}$ to $\mathbf{12}_{1,p}$ by using the score (first score) by calculation cell indicating whether or not the absolute value of the degree of deviation exceeds the threshold X for the upper-stage calculation cells $\mathbf{12}_{1,1}$ to $\mathbf{12}_{1,p}$, and calculates the upper-stage adjacent product vector.

FIG. 13 is an example of a case where the absolute values of the degrees of deviation of the calculation cell $\mathbf{12}_{1,3}$, the calculation cell $\mathbf{12}_{1,4}$, and the calculation cell $\mathbf{12}_{1,5}$ exceed the threshold X in the upper-stage calculation cells $\mathbf{12}_{1,1}$ to $\mathbf{12}_{1,p}$, and the upper-stage adjacent product vector is (0, 0, 0, 1, 0,0, . . . , 0, 0, 0). Note that a method of obtaining the upper-stage adjacent product vector is the same as the method of obtaining the adjacent product vector described with reference to FIG. 12, and thus a detailed description thereof will be omitted here.

The lower-stage calculation cells $\mathbf{12}_{2,1}$ to $\mathbf{12}_{2,p}$ then calculates the sum of the score vector by calculation cell, and the elements of the forward shift vector and the backward shift vector, and sets the score of the calculation cell $12_{2,1}$ to $12_{2,p}$ to one point if any one of the calculation cells has a score. A vector obtained by arranging these scores is defined as a lower-stage adjacent sum vector. A vector obtained by multiplying the elements of the upper-stage adjacent product vector and the lower-stage adjacent sum vector is then defined as an upper/lower adjacent product vector. Finally, it is determined that adjacency is established if any of the elements of the upper/lower adjacent product vector has a score (second score) of one.

The example illustrated in FIG. 13 is a case where the absolute value of the degree of deviation of the calculation cell $12_{2,3}$ exceeds the threshold X among the lower-stage calculation cells $12_{2,1}$ to $12_{2,p}$, and the lower-stage adjacent sum vector is (0, 1, 1, 1, 0, 0, . . . , 0, 0, 0). Since the upper/lower adjacent product vector is (0, 0, 0, 1, 0, 0, . . . , 0, 0, 0) and there is an element scored one point as the second score, it can be determined that adjacency is established.

The determination of adjacency allows to determine the position where a seizure has occurred in the mold 5. Increasing the number of stages of the thermometers 8 in the casting direction A allows to grasp a state in which the fractured portion 11 is longitudinally propagated in the casting direction A by a phenomenon in which the determination of adjacency is propagated in the casting direction A, when a seizure leading to breakout occurs.

Therefore, the determination method of adjacency described with reference to FIG. 13 can determine that a sign such as seizure leading to breakout occurs if any element of the upper/lower adjacent product vector is 1.

Note that, in the above description of the present embodiment, the arrangement positions of the calculation cells $12_{1,1}$ to $12_{k,p}$ in the mold 5 are not taken into consideration, but the thermometers $8_{1,1}$ to $8_{m,n}$ arranged on the long-side cooling plate 5*a* and the short-side cooling plate 5*b* of the mold 5 and arranged on the front surface side and the back surface side of the mold 5 execute interpolation processing respectively and separately, and the second score is calculated based on the adjacency state of the calculation cells $12_{1,1}$ to $12_{k,p}$ for each surface, whereby more accurate discrimination can be performed. The number of adjacent points for obtaining the adjacent product vector and the adjacent sum vector is not limited to three but may be changed.

The phenomenon of breakout in the mold 5 in a continuous casting process is manifested not only in lateral propagation but also in a change in temperature behavior from upstream to downstream in the casting direction A (from top to bottom of the mold 5). In other words, the fractured portion 11 of the solidified shell 10 moves downward while repeating a phenomenon in which the mold 5 and the molten steel 2 come into contact with each other due to some factor to cause seizure, the solidified shell 10 is stuck by the mold 5, and further seizure occurs at the fractured portion 11 of the solidified shell 10, which is generated directly under the seizure because the molten steel 2 is withdrawn from the lower portion of the mold 5, when the mold 5 and the molten steel 2 come into contact with each other. For the calculation cells 12 in the upper and lower two stages, the logical product of the adjacent sum vectors in each stage is calculated to determine the adjacency in the upper and lower stages (the occurrence state of the same phenomenon in adjacent places). Therefore, it is not necessary for all of the plurality of thermometers 8 and the plurality of calculation cells 12 to be arranged at the same distance from the upper end of the mold 5 in the casting direction A.

Figure 14:
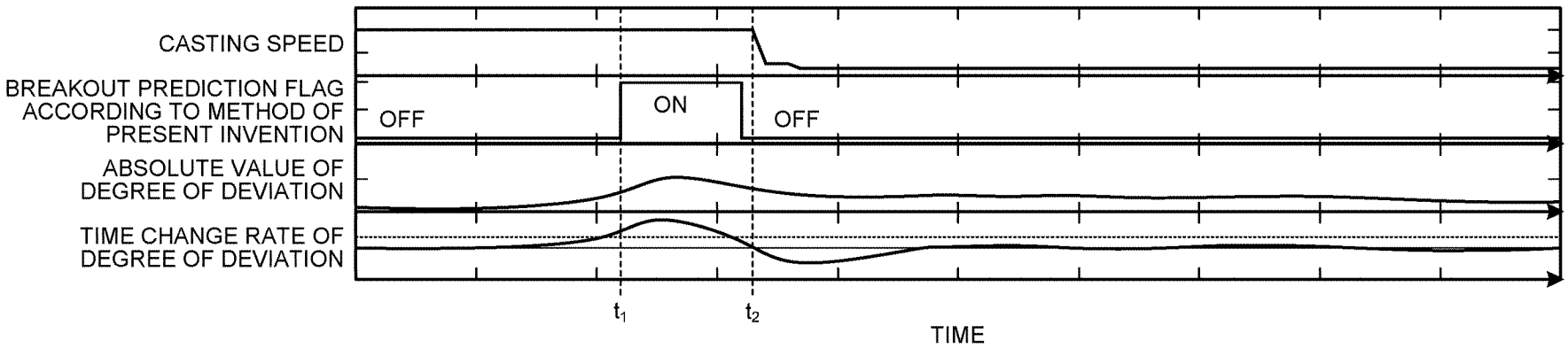
FIG. 14 is a graph of time-series detection data in a case where a breakout has been predicted by the breakout prediction method according to the embodiment of the present invention.

FIG. 14 is a graph of time-series detection data in a case where a breakout has been predicted by the breakout prediction method according to the embodiment of the present invention (the method of the present invention). Note that, in FIG. 14, a time $t_1$ is a moment when a breakout has been predicted by the breakout prediction method according to the embodiment of the present invention. In FIG. 14, a time $t_2$ is a moment when a breakout has been predicted by the conventional breakout prediction method. Note that the conventional breakout prediction method is a method of predicting a breakout when the detected temperature of the upper-stage thermometer 8 in the thermometer 8 arranged in two stage is lower than the detected temperature of the lower-stage thermometer 8 for a certain period of time. At time $t_2$, the breakout is predicted, thereby starting the control for reducing the casting speed to a predetermined value.

As illustrated in FIG. 14, the use of the breakout prediction method according to the embodiment of the present invention can predict the breakout at an earlier timing than the conventional breakout prediction method in which the temperature change amount is obtained with respect to the time-series data of the detected temperature.

Table 1 below illustrates results obtained when the breakout prediction method according to the embodiment of the present invention (the method of the present invention) is applied to past breakout prediction cases. Note that, in Table 1 below, Case 1 and Case 5 are cases where a breakout has occurred, and Case 2 to Case 4 are cases where a breakout has not occurred. In Table 1 below, "correct detection" refers to a case where a breakout has occurred, in which the occurrence of a sign leading to breakout has been correctly detected, and thus the occurrence of breakout has been correctly predicted. In Table 1 below, "over-detection" refers to a case where a breakout has not occurred, in which the occurrence of a sign leading to breakout has been over-detected (erroneous detection), and thus the occurrence of breakout has been erroneously predicted. In Table 1 below, "non-detection" refers to a case where a breakout has not occurred, in which the occurrence of a sign leading to breakout has not been detected, and the occurrence of breakout has not been predicted.

TABLE 1

| | Conventional method | Method of present invention |
|---|---|---|
| Case 1 | Correct detection | Correct detection |
| Case 2 | Over-detection | Non-detection |
| Case 3 | Over-detection | Non-detection |
| Case 4 | Over-detection | Non-detection |
| Case 5 | Correct detection | Correct detection |

As can be seen from Table 1, according to the breakout prediction method of the embodiment of the present invention, the occurrence of all signs leading to breakout can be correctly detected and the occurrence of breakout can be correctly predicted for past cases where a breakout has occurred, and the over-detection (erroneous detection) which has occurred in the conventional method does not occur at all for past cases where a breakout has not occurred.

INDUSTRIAL APPLICABILITY

The present invention can provide a breakout prediction method, an operation method of a continuous casting machine, and a breakout prediction device capable of accurately predicting a breakout.

REFERENCE SIGNS LIST

1 CONTINUOUS CASTING MACHINE
2 MOLTEN STEEL
3 TUNDISH
4 IMMERSION NOZZLE
5 MOLD
6 SOLID PRODUCT
7 SOLID PRODUCT SUPPORT ROLL
8 THERMOMETER
10 SOLIDIFIED SHELL
11 FRACTURED PORTION
20 DETERMINATION UNIT

The invention claimed is:

1. A breakout prediction method comprising:

a step of inputting a dimension of a solid product withdrawn from a mold in a continuous casting machine;

a step of detecting a temperature of the mold by a plurality of thermometers embedded in the mold;

a step of executing interpolation processing on the detected temperatures detected by the plurality of thermometers according to the dimension of the solid product;

a step of calculating, based on temperatures calculated by executing the interpolation processing, a component in a direction orthogonal to an influence coefficient vector obtained by principal component analysis as a degree of deviation from during a normal operation in which a breakout has not occurred; and a step of predicting a breakout based on the degree of deviation.

2. The breakout prediction method according to claim 1, wherein the step of executing the interpolation processing includes calculating the temperatures by executing the interpolation processing on the detected temperature of each of the plurality of thermometers, at a center point of each of a plurality of calculation cells equally divided according to the dimension of the solid product.

3. The breakout prediction method according to claim 2, wherein a number of the calculation cells is kept constant even when the dimension of the solid product is changed.

4. The breakout prediction method according to claim 3, wherein the step of calculating as the degree of deviation includes obtaining an average value of a temperature of each of the plurality of calculation cells located at a same distance from an upper end of the mold in a casting direction of a molten steel with respect to the mold, obtaining a difference from the average value for the temperature of each of the plurality of calculation cells, and calculating the degree of deviation from the obtained difference using the influence coefficient vector.

5. The breakout prediction method according to claim 2, wherein the step of calculating as the degree of deviation includes obtaining an average value of a temperature of each of the plurality of calculation cells located at a same distance from an upper end of the mold in a casting direction of a molten steel with respect to the mold, obtaining a difference from the average value for the temperature of each of the plurality of calculation cells, and calculating the degree of deviation from the obtained difference using the influence coefficient vector.

6. The breakout prediction method according to claim 5, wherein the step of predicting the breakout includes predicting the breakout based on an adjacency of the calculation cell in which an absolute value of the degree of deviation exceeds a preset second threshold when a time change rate of the degree of deviation exceeds a preset first threshold.

7. The breakout prediction method according to claim 6, wherein the step of predicting the breakout includes a step of giving a first score to the calculation cell in which the degree of deviation exceeds the second threshold, a step of calculating a second score from the first score based on the adjacency of the calculation cell to which the first score is given, and a step of predicting the breakout based on the second score.

8. The breakout prediction method according to claim 1, wherein the influence coefficient vector is a sensitivity coefficient vector having a sensitivity coefficient of each of the plurality of thermometers as a component.

9. An operation method of a continuous casting machine, the method comprising reducing a casting speed at which molten steel is poured into the mold when a breakout is predicted based on the breakout prediction method according to claim 1.

10. A breakout prediction device comprising:

an input unit configured to input a dimension of a solid product withdrawn from a mold in a continuous casting machine;

a plurality of thermometers embedded in the mold and configured to detect a temperature of the mold;

an interpolation processing execution unit configured to execute interpolation processing on the detected temperatures detected by the plurality of thermometers according to the dimension of the solid product;

a degree-of-deviation calculation unit configured to calculate, based on temperatures calculated by executing the interpolation processing, a component in a direction orthogonal to an influence coefficient vector obtained by principal component analysis as a degree of deviation from during a normal operation in which a breakout has not occurred; and a breakout prediction unit configured to predict a breakout based on the degree of deviation.

* * * * *